US008550316B2

(12) United States Patent
Coote

(10) Patent No.: US 8,550,316 B2
(45) Date of Patent: Oct. 8, 2013

(54) BABY CARRIER

(76) Inventor: Diana Coote, Charlotte, NC (US)

( * ) Notice: Subject to any disclaimer, the term of this patent is extended or adjusted under 35 U.S.C. 154(b) by 626 days.

(21) Appl. No.: 12/128,198

(22) Filed: May 28, 2008

(65) Prior Publication Data

US 2009/0078729 A1 Mar. 26, 2009

Related U.S. Application Data

(60) Provisional application No. 60/994,871, filed on Sep. 21, 2007.

(51) Int. Cl.
*A61G 1/00* (2006.01)

(52) U.S. Cl.
USPC ..... 224/160; 224/159; 297/467; 297/468

(58) Field of Classification Search
USPC ..... 224/159–161; 497/468; 297/468, 297/467, 487
See application file for complete search history.

(56) References Cited

U.S. PATENT DOCUMENTS

| | | | | |
|---|---|---|---|---|
| 2,652,183 | A * | 9/1953 | Hlivka | 297/229 |
| 3,604,750 | A * | 9/1971 | Doering | 297/467 |
| 4,009,808 | A * | 3/1977 | Sharp | 224/160 |
| 4,050,737 | A * | 9/1977 | Jordan | 297/465 |
| 4,235,474 | A * | 11/1980 | Rosenberg | 297/465 |
| 4,324,430 | A * | 4/1982 | Dimas et al. | 297/256.17 |
| 4,402,440 | A | 9/1983 | Purtzer et al. | |
| 4,469,259 | A * | 9/1984 | Krich et al. | 224/160 |
| 5,205,450 | A * | 4/1993 | Derosier | 224/161 |
| 5,246,152 | A * | 9/1993 | Dotseth | 224/159 |
| D395,161 | S | 6/1998 | Fair et al. | |
| 5,797,785 | A | 8/1998 | Silberstein | |
| 6,065,655 | A | 5/2000 | Parewick | |
| 6,073,820 | A | 6/2000 | Drobinski | |
| D444,983 | S | 7/2001 | Norman | |
| D452,993 | S | 1/2002 | Norman | |
| D453,066 | S | 1/2002 | Norman | |
| D455,546 | S | 4/2002 | Norman | |
| D458,503 | S | 6/2002 | Norman | |
| D459,136 | S | 6/2002 | Norman | |
| 6,443,339 | B1 * | 9/2002 | Higuchi | 224/160 |

(Continued)

OTHER PUBLICATIONS

Mommysentials, LLC website; pp. 1-4, "http://www.mommysentials.com/news.htm"; Jan. 15, 2008.

(Continued)

*Primary Examiner* — Nathan J Newhouse
*Assistant Examiner* — Corey Skurdal
(74) *Attorney, Agent, or Firm* — Patrick Reilly; Colin Fowler

(57) ABSTRACT

A method and apparatus for securing a child to a wearer in a first arrangement and for securing a child to a chair in a second arrangement is provided. According to one embodiment, an apparatus includes a base panel having a first edge, a second edge, and opposing third and fourth edges. The apparatus also includes a crotch panel having first and second securing devices and attached to the second edge of the base panel, where the securing devices of the crotch panel are configured to wrap around the back portion of the chair and fasten to each other. The apparatus further includes a waist panel attached to the second edge of the base panel such that the base panel is configured to wrap around the waist of the wearer in the first arrangement and to wrap around the seat portion of the chair such that the child situated within the apparatus is unable to stand upright in the second arrangement.

7 Claims, 10 Drawing Sheets

(56) References Cited

U.S. PATENT DOCUMENTS

| | | | | |
|---|---|---|---|---|
| 6,475,057 | B1 | 11/2002 | Norman | |
| D467,458 | S | 12/2002 | Norman | |
| 6,598,771 | B2 | 7/2003 | Norman | |
| 6,763,983 | B2 | 7/2004 | Norman | |
| 6,814,405 | B2 | 11/2004 | Norman | |
| 6,851,749 | B2 | 2/2005 | Norman | |
| 7,252,214 | B2 * | 8/2007 | Krogh | 224/160 |
| 2002/0183706 | A1 | 12/2002 | Valentin et al. | |
| 2002/0193728 | A1 | 12/2002 | Infantino et al. | |
| 2004/0238579 | A1 * | 12/2004 | Krogh | 224/160 |
| 2005/0051582 | A1 | 3/2005 | Frost | |
| 2005/0287909 | A1 | 12/2005 | Gelfond | |
| 2007/0066446 | A1 | 3/2007 | Gelfond et al. | |
| 2009/0206116 | A1 * | 8/2009 | Grant | 224/160 |

OTHER PUBLICATIONS

Mommysentials product from website; 2 pages, http://www.mommysentials.com/images/product_pics/large/babykeeperbasicnewlarge2.jpg; Jan. 15, 2008.

Kozy Carrier from website; 18 pages; located at "http://kozycarrier.homestead.com/instructions.html"; Jan. 15, 2008.

Infantino 6inOneRider; Owner's Manual; pp. 1-7; © 2005 Infantino, LLC, San Diego, CA 92121 USA.

* cited by examiner

BABY CARRIER

CROSS-REFERENCE TO RELATED APPLICATIONS

This application claims the benefit under 35 U.S.C. §119 (e) of U.S. provisional application 60/994,871 filed Sep. 21, 2007, the contents of which are incorporated by reference herein.

BACKGROUND OF THE INVENTION

The present invention relates to carriers and, more specifically, to baby carriers that can be mounted on a person.

In many applications, particularly for products involving transporting and securing children, it is important to provide devices that are safe and multi-purpose. Typically, baby carriers are constructed in a way that secures a child to the wearer of the carrier while also providing support for the child. Parents and others that are responsible for children often transport their children using baby carriers because it frees up their hands, keeps their children under their close supervision, and the like. Unfortunately, most of the current baby carriers provide no other function besides providing a way of transporting children.

Thus, there exists a need for a multi-purpose baby carrier. It would be advantageous to have a baby carrier that can provide a second function in addition to transporting children.

BRIEF SUMMARY OF THE INVENTION

Embodiments of the invention may address the above needs and achieve other advantages by providing an apparatus for securing a child to a wearer in a first arrangement and for securing a child to a chair in a second arrangement.

In one embodiment of the invention, an apparatus for securing a child to a wearer in a first arrangement and for securing a child to a chair in a second arrangement includes a base panel having a first edge, a second edge, and opposing third and fourth edges, as well as a first loop and a second loop attached to the third and fourth edges, respectively. The apparatus also includes a crotch panel having first and second securing devices and attached to the second edge of the base panel, where the first and second securing devices are configured to be threaded at least partially through the first and second loops, respectively, and where the securing devices of the crotch panel are configured to wrap around the back portion of the chair and fasten to each other. The apparatus further includes a waist panel attached to the second edge of the base panel such that the base panel is substantially centered upon the waist panel and includes opposing ends, each end having a waist fastening device, where the waist panel is configured to wrap around the waist of the wearer in the first arrangement and to wrap around the seat portion of the chair such that the child situated within the apparatus is unable to stand upright in the second arrangement and where the waist fastening devices are configured to fasten to each other.

An additional embodiment of the invention provides a method of securing a child to a chair that includes providing an apparatus for securing the child to a wearer in a first arrangement and for securing the child to the chair in a second arrangement with a base panel having a first edge, a second edge, and opposing third and fourth edges, as well as a first loop and a second loop attached to the third and fourth edges, respectively. The apparatus provided in the method also includes a crotch panel having first and second securing devices and attached to the second edge of the base panel, where the first and second securing devices are configured to be threaded at least partially through the first and second loops, respectively, and where the securing devices of the crotch panel are configured to wrap around the back portion of the chair and fasten to each other. The apparatus provided in the method further includes a waist panel attached to the second edge of the base panel such that the base panel is substantially centered upon the waist panel and includes opposing ends, each end having a waist fastening device, where the waist panel is configured to wrap around the waist of the wearer in the first arrangement and to wrap around the seat portion of the chair such that the child situated within the apparatus is unable to stand upright in the second arrangement and where the waist fastening devices are configured to fasten to each other. The method includes placing the apparatus on the chair with the crotch panel facing away from the back portion of the chair and moving the first and second securing devices of the crotch panel through the first and second loops, respectively, of the base panel. The method also includes extending the first and second securing devices of the crotch panel around the back portion of the chair. The method further includes fastening the first and second securing devices of the crotch panel and securing the waist panel around the seat portion of the chair.

Another embodiment of the present invention provides an apparatus for securing a child to a wearer in a first arrangement and for securing a child to a chair in a second arrangement including a base panel having a first edge, a second edge, and opposing third and fourth edges. The apparatus includes a first loop and a second loop attached to the third and fourth edges, respectively, and a crotch panel having first and second securing devices and attached to the second edge of the base panel, where the first and second securing devices are configured to be threaded at least partially through the first and second loops, respectively, and where the securing devices of the crotch panel are configured to wrap around the back portion of the chair and fasten to each other. The apparatus also includes a waist panel attached to the second edge of the base panel, where the waist panel is configured to wrap around the waist of the wearer and lay flat against the wearer in the first arrangement and to wrap around the seat portion of the chair and lay flat against the chair such that a child situated within the apparatus is unable to stand upright in the second arrangement and where the waist fastening devices are configured to fasten to each other.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIGS. 1*a*-1*c* illustrate a baby carrier worn by a wearer in multiple configurations;

FIG. 1*d* illustrates a baby carrier with a child secured to a chair;

FIG. 2 shows a baby carrier viewed from the crotch panel side;

FIGS. 3*a*-3*b* illustrate a baby carrier with securing devices wrapped around a chair;

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1A:
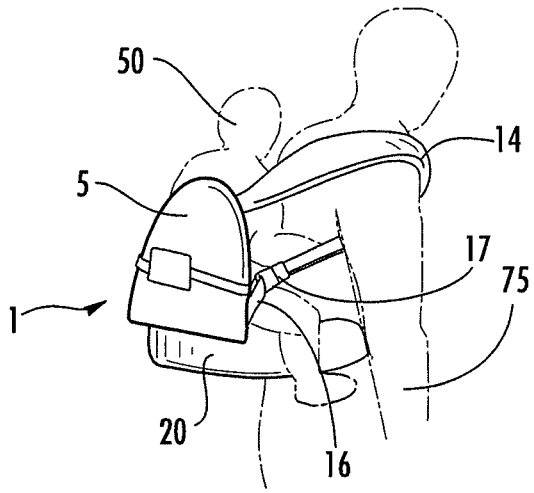
Figure 1C:
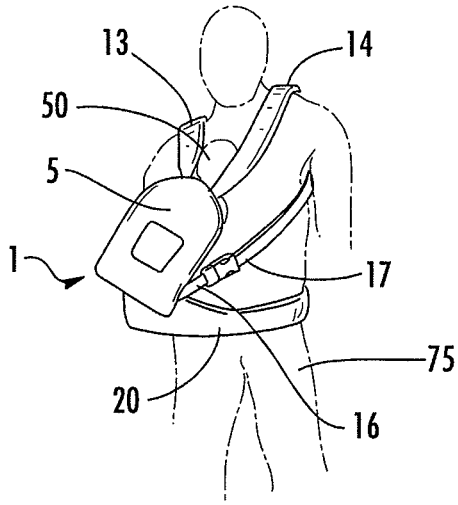
Figure 1B:
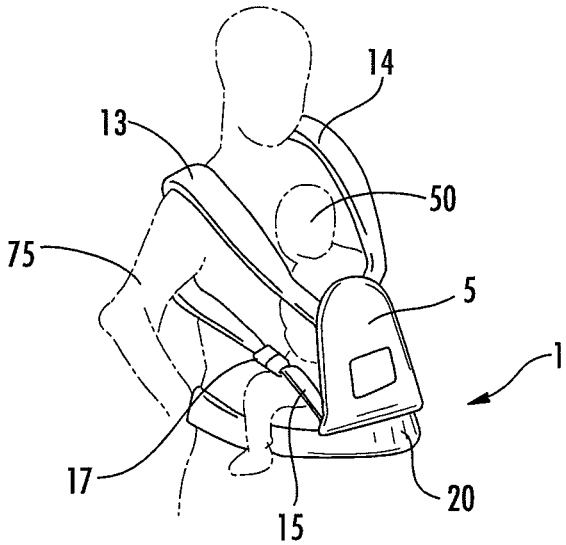

As shown in FIGS. 1*a*-1*c*, there are several ways for a baby carrier 1 to be mounted upon the torso of a person (wearer) 75. In FIG. 1*a*, the baby carrier 1 is mounted upon the back of a wearer 75 so that a child 50 secured in the baby carrier 1 faces in the same direction as the wearer 75. In FIG. 1*b*, the baby carrier 1 is mounted upon the front of the wearer 75 so that the child 50 faces in the opposite direction of the direction faced by the wearer 75. In FIG. 1*c*, the baby carrier 1 is mounted upon the side of the wearer 75 so that the child 50 faces in a direction that is substantially perpendicular to the direction faced by the wearer 75. In effect, the baby carrier 1 may be mounted upon the torso of a wearer 75 in a number of ways by, for example, adjusting one or both of arm panels 13,14. As shown in Figure Id, the baby carrier 1 is also configurable as a seat harness. As will be described in greater detail below, the baby carrier 1 may be configured to secure a child 50 to an adult-sized chair or other types of chairs.

Figure 1D:
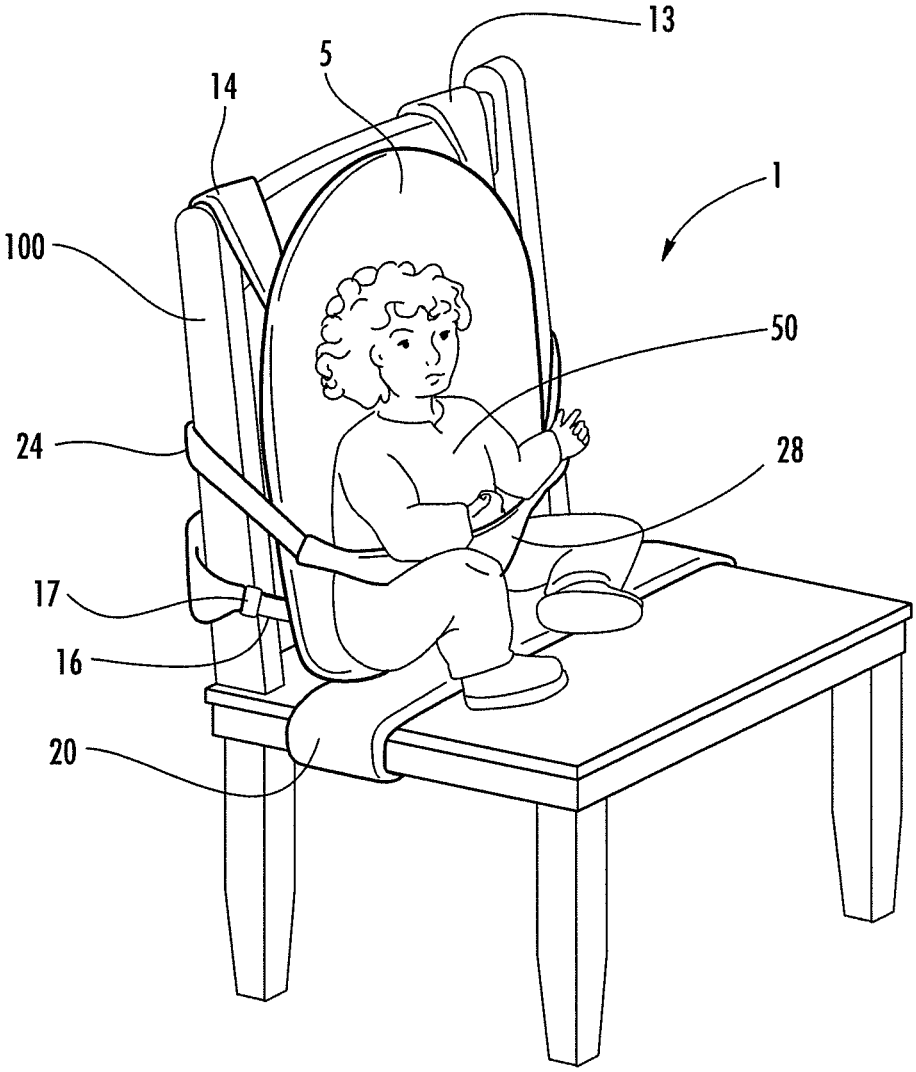
Figure 2:
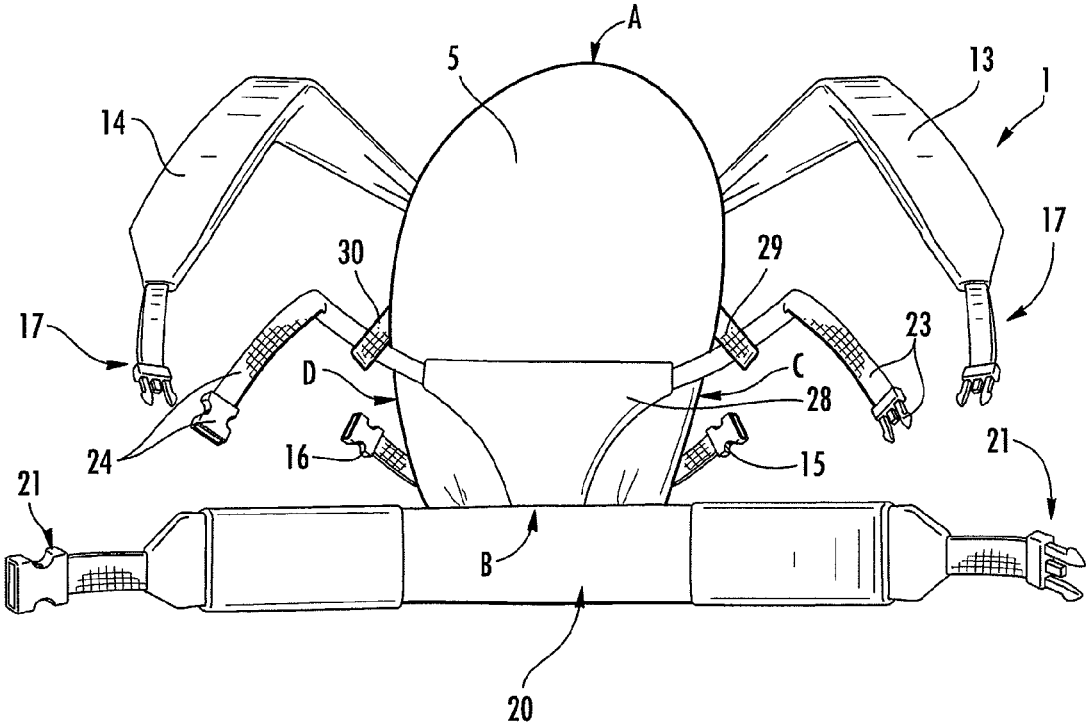
Figure 3A:
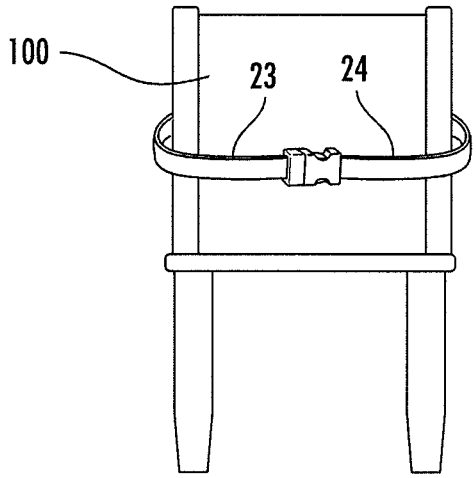
Figure 3B:
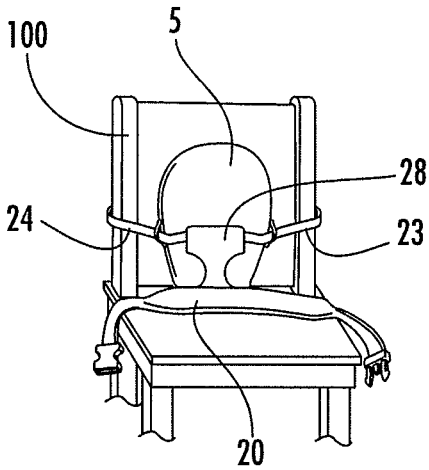

Referring now to FIG. 2, there is shown a baby carrier 1 having a base panel 5, waist panel 20, crotch panel 28, first and second base fastening devices 15,16, and arm panels 13,14. The base panel 5, waist panel 20, crotch panel 28, and arm panels 13,14 may be made from various materials including canvas, nylon, synthetic fiber, or any type of natural or artificial fibers and may include washable, deformable, and dryable materials. The base panel 5 may typically have the same shape as that shown in FIG. 2 but may have other shapes, such as rectangular, hour-glass, or the like. The base panel 5 supports the child's back, buttocks, and upper legs when the child 50 is secured to the wearer 75. See, for example, FIGS. 1*a*-1*c*. In FIG. 2, base panel 5 includes a first edge A, second edge B, and opposing third and fourth edges C,D. The second edge B is attached to the bottom portion of the crotch panel 28 and the top portion of the waist panel 20 by stitching, gluing, or the like. The base panel 5 may be substantially centered upon the waist panel 20 or may have another configuration. Acting with the base panel 5, the crotch panel 28 is designed to support the child's back, buttocks, and upper legs when the child 50 is secured to a chair 100. See, for example, FIG. 1*d*. Both the base panel 5 and crotch panel 28 may contain padding or the like for improved comfort. Typically, the crotch panel 28 is shaped like a 'T' with fillets at the inner edges or like a diamond shape but may have other configurations. The crotch panel 28 includes two securing devices 23,24 on opposing sides that are able to be fastened together. The securing devices 23,24 may be any type of fastener, including variations of the male and female fasteners shown in FIG. 2, hook and loop fasteners, snap connectors, or the like. The securing devices 23,24 may be formed of rubber, plastic, fabric, or the like. As shown in FIGS. 3A and 3B, securing devices 23,24 are configured to wrap around the back portion of a chair 100 and fasten to each other, such that the crotch panel 28 is in a position to receive and secure a child 50. Securing device 23 may be shaped and dimensioned so that it can be threaded through loop 29, and securing device 24 may be shaped and dimensioned so that it can be threaded through loop 30. Loops 29,30 may be attached to the third edge C and fourth edge D, respectively, by a piece of thread (i.e., sewing the pieces together), glue, or various other items used to secure objects, particularly fabrics, together. Generally, each loop 29,30 includes a length of material that is secured to the base panel 5 on both ends such that an opening is created between the ends. See, for example, FIG. 2. The cross-section of each loop 29,30 may be circular, triangular, rectangular, or the like. Also, loops 29,30 may be formed of rubber, plastic, fabric, or the like.

Figure 4:
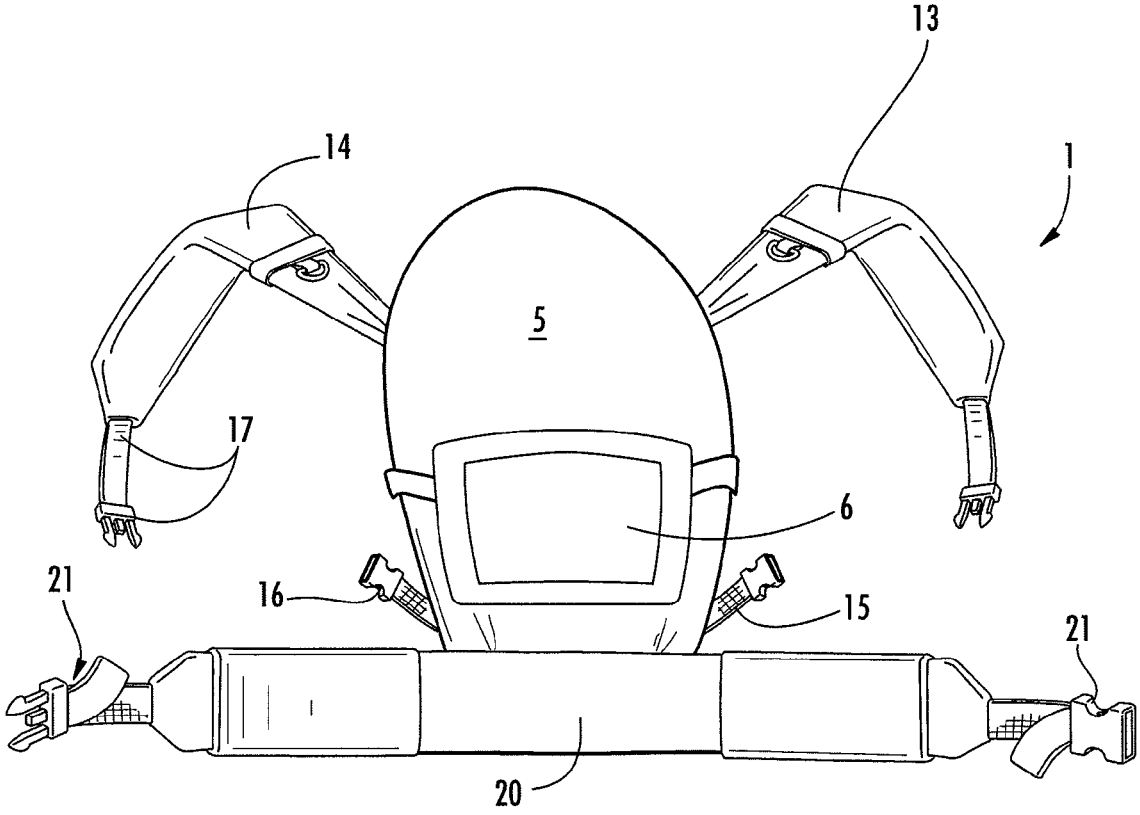
FIG. 4 shows a baby carrier with a pocket.

As seen in FIG. 4, the shape of waist panel 20 may typically be like that of a belt but may have other shapes. As shown in Figures la-Id, the waist panel 20 may be configured to fit around the waists of most persons in the first arrangement and the seat portions of most chairs in the second arrangement. The waist panel 20 includes two fastening devices 21 on opposing sides that are able to be fastened together. The fastening devices 21 may be fastened together to hold the waist panel 20 against the wearer 75 or against the seat portion of the chair 100. The fastening devices 21 may be the same type of fastener as the securing devices 23,24 or may be different types of fasteners.

The base fastening devices 15,16 may each include a belt portion having an adjustable securing device, hook or loop pad, snap connector, or the like on one end of the belt. A first base fastening device 15 may be attached to the third edge C of the base panel 5 by stitching, gluing, or the like, and a second base fastening device 16 may be attached to the fourth edge D of the base panel 5 by stitching, gluing, or the like. Alternatively, the base fastening devices 15,16 may each be attached to the waist panel 20 by stitching, gluing, or the like, for example between opposing surfaces of the base panel 5 such that the attachment location of the base fastening devices 15,16 is hidden. The base fastening devices 15,16 may then be passed through openings in the third edge C and fourth edge D of the base panel 5 to expose the securing device on the end of each belt portion and may thus have the appearance of being "free-floating." In addition, first and second arm panels 13,14 may be attached to the third edge C and the fourth edge D, respectively, of the base panel 5 by stitching, gluing, or the like. As shown in FIGS. 1*a*-1*d*, the arm panels 13,14 may be wrapped around the shoulders of a wearer 75 or the back portion of a chair 100 and be able to fasten to respective fastening devices 15,16.

The arm panels 13,14 may typically have the same shape as that shown in FIG. 4 but may have other shapes. The arm panels 13,14 may be formed of the same material as the base panel 5 or may be formed of a different material. The arm panels 13,14 are typically designed to withstand the strain of supporting a child 50 and also reducing the discomfort for the wearer 75. As such, the arm panels 13,14 may include padding or other features that provide comfort for the wearer 75 of the baby carrier 1. The padding may also afford protection for the back portion of chairs 100 from scratching or the like by the arm panels 13,14. As can be seen in FIG. 4, the base fastening devices 15,16 may be proximate the second edge B of the base panel 5, while the arm panels 13,14 may be proximate the first edge A of the base panel 5. Of course, the baby carrier 1 shown in FIGS. 2 and 4 is generally how most carriers would be arranged. However, other arrangements may be used.

Figure 5:
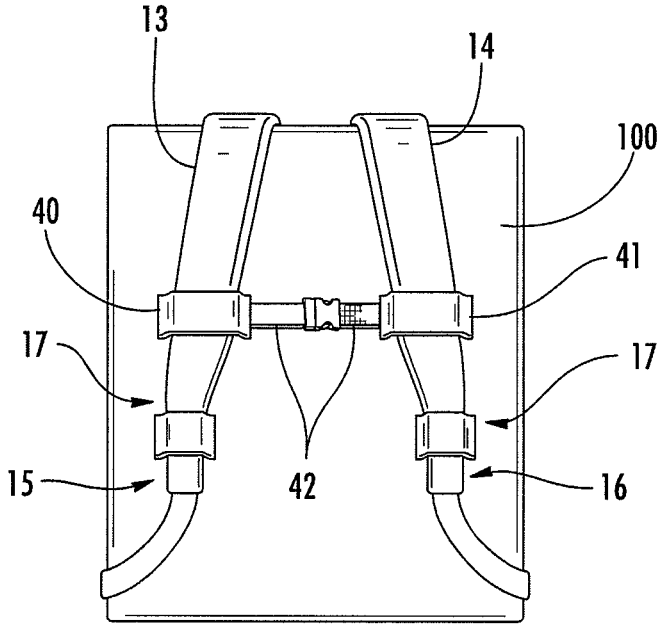
FIG. 5 shows a baby carrier with elbow fasteners.

The baby carrier 1 may also include first and second elbow fasteners 40,41 that can cause at least a portion of the first and second arm panels 13,14 to be maintained at a substantially fixed distance from one another. Each elbow fastener 40,41 may be configured to wrap around an arm panel 13,14 and include an elbow securing device 42 that can fasten to other elbow securing devices 42. When each elbow fastener 40,41 is wrapped around an arm panel 13,14 and fastened to an opposing elbow fastener 40,41, then the arm panels 13,14 are restricted from moving beyond the distance between elbow fasteners 40,41. See, for example, FIG. 5.

The base panel 5 may also include a pocket 6, as seen in FIG. 4. The pocket 6 may typically be on the back side of the base panel 5 (i.e., on the opposite side of the crotch panel) or may be on other locations of the base panel 5. The pocket 6 may be configured to receive the first and second securing devices 23,24. The first and second securing devices 23,24 may typically be stored in the pocket 6 while the baby carrier 1 is mounted on a person 75. When the baby carrier 1 is to be used to secure a child 50 to a chair 100, the first and second securing devices 23,24 may be taken out of the pocket 6, wrapped around the back portion of the chair 100, and fastened together.

Figure 6:
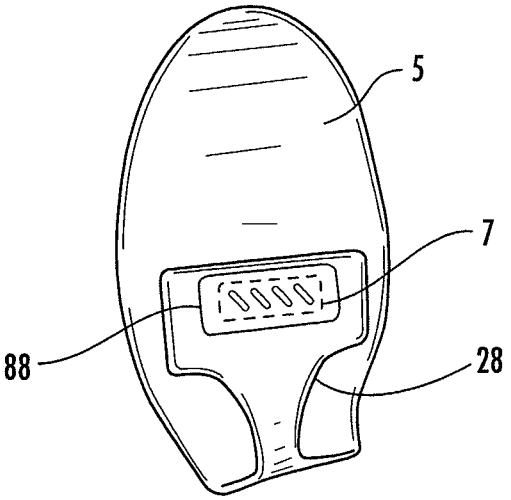
FIG. 6 illustrates a baby carrier with a third base fastening device and a crotch fastening device.

As shown in FIG. 6, the front side of the base panel 5 may also include a third base fastening device 7 that is configured to secure the crotch panel 28 against the base panel 5. For example, crotch panel 28 may include a crotch fastening device 88, which may be a hook and loop fastener or the like, that can be secured to the third base fastening device 7, which may be a hook and loop fastener or the like. When the baby carrier 1 is mounted on a wearer 75, it may be preferable to secure the crotch panel 28 against the base panel 5 so the crotch panel 28 does not interfere with or cause discomfort for the child 50.

Figure 7:
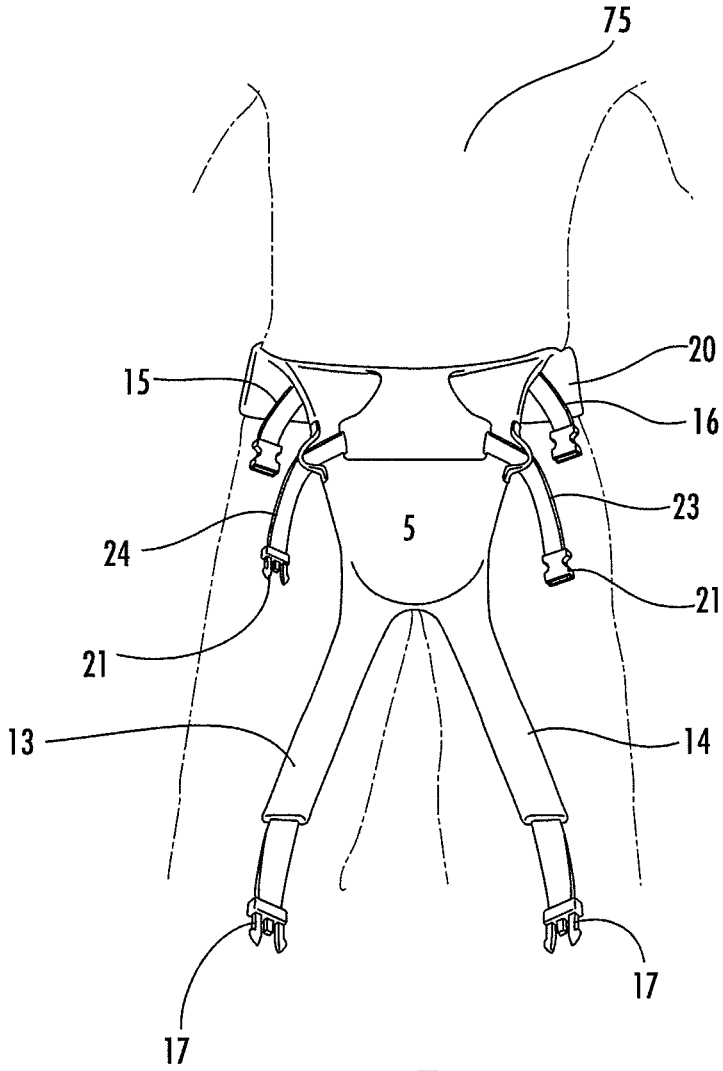
FIGS. 7 and 8 show a baby carrier with the waist panel wrapped around a wearer.
Figure 8:
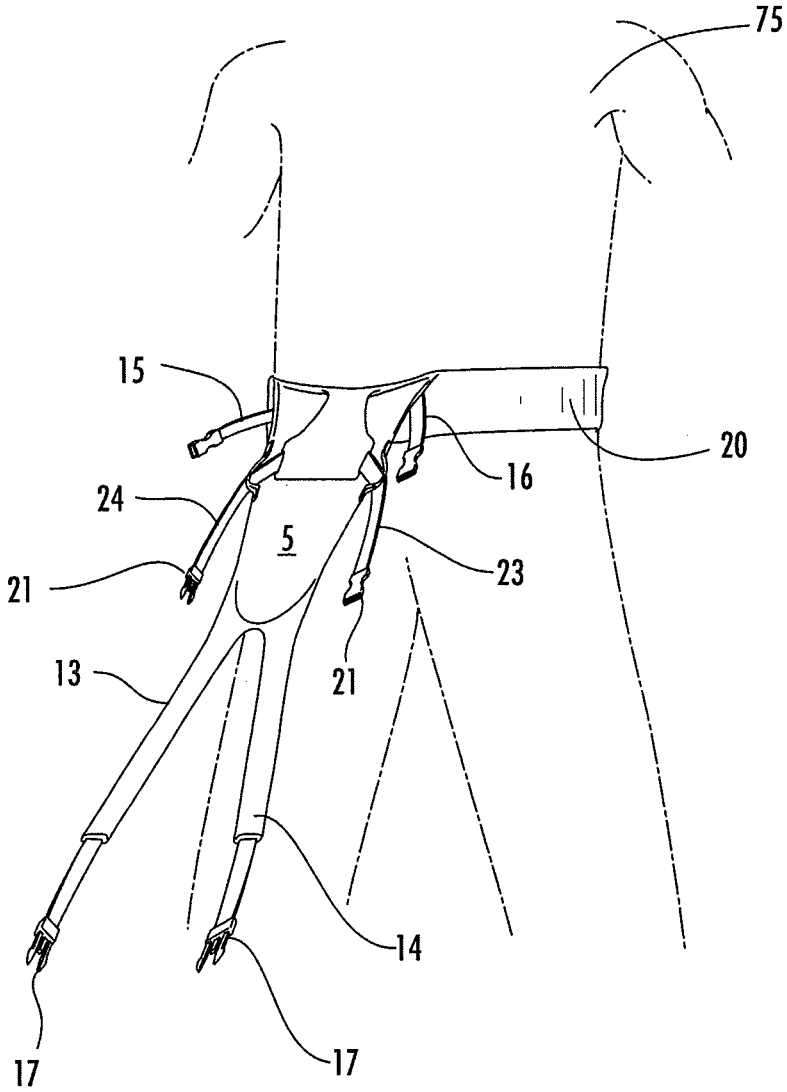

To use the baby carrier 1 to secure a child 50 to a person's torso, the waist panel 20 must first be fastened around the person's waist, as shown in FIG. 7. The waist panel 20 may typically lay flat against the person's waist but may have another configuration. The next step is determined by whether the child 50 will be situated on the front, side, or back of the person. If the child 50 is to be situated on the front of the wearer 75, the arm panels 13,14 and base panel 5 should be hanging in front of the wearer 75. Then, the wearer 75 may hold the child 50 so that the child 50 is straddling the wearer 75 and facing the wearer's front side. The wearer 75 may then wrap an arm panel 13,14 over each shoulder and fasten the arm panels 13,14 to base fastening devices 15,16. Alternatively, the wearer 75 may wrap at least one arm panel 13,14 around the wearer's shoulder and fasten it to a base fastening device 15,16. The child 50 may then be situated so that the child 50 is straddling the wearer's waist. If it has not already been done, the other arm panel 13,14 is then wrapped around the wearer's other shoulder and fastened into the other base fastening device 15,16. The arm panels 13,14, waist panels 20, and other devices may then be adjusted such that the child 50 is secured against the wearer 75. In order to situate the child 50 on the side or back of the person, the same steps described above would be used except the base panel 5 and arm panels 13,14 would be initially hanging from the side and back, respectively, of the wearer 75. For instance, FIG. 8 shows a baby carrier 1 hanging from the side of the wearer 75. Also, the child 50 would be straddling the wearer 75 in such a way that the child 50 would face the side or back of the wearer 75.

Figure 9:
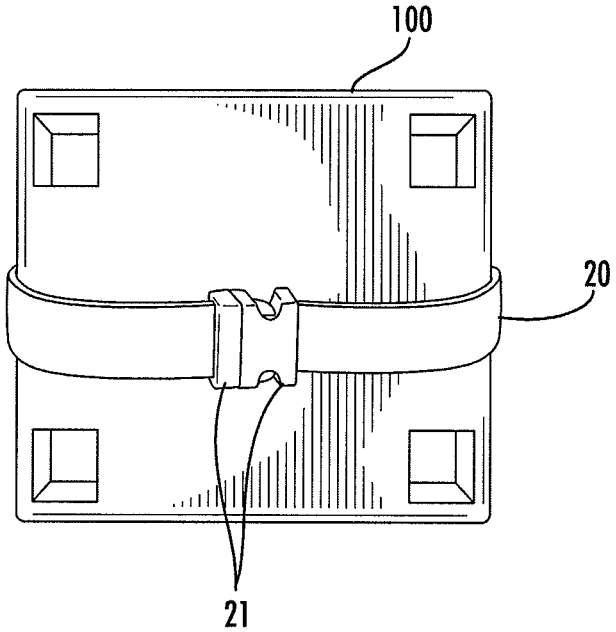
FIG. 9 illustrates a baby carrier with waist panel wrapped around the seat portion of a chair.

To use the baby carrier 1 to secure a child 50 to a chair 100, i.e., a seat harness, a baby carrier 1, as described above, is placed on a chair 100 with the crotch panel 28 (i.e., front side of the base panel 5) facing away from the back portion of the chair 100 by restricting the movement of the arm panels. If not already done so, first and second securing devices 23,24 of the crotch panel 28 may be threaded through the first and second loops 29,30, respectively, of the base panel 5. The first and second securing devices 23,24 of the crotch panel 28 may then be extended around the sides of the back portion of the chair 100 and fastened together. The first and second arm panels 13,14 may be wrapped over the back portion of a chair 100, and each arm panel 13,14 may be fastened to one of the base fastening devices 15,16. Of course, the first and second arm panels 13,14 may already be fastened together. In that case, the arm panels 13,14 may simply be positioned over the back portion of the chair 100. First and second elbow fasteners 40,41 may be fastened to each other to provide greater security for the child 50 secured to the chair 100. See, for example, FIG. 5. Next, the waist panel 20 may be secured around the seat portion of the chair 100. As shown in FIG. 9, the waist panel 20 may typically lay flat against the seat portion of the chair 100 but may have other configurations. A child 50 may be placed within the baby carrier 1 so that the child 50 sits between the crotch panel 28 and the base panel 5 with the child's legs sticking out of the open portions between the crotch panel 28 and base panel 5. See, for example, FIG. 1*d*. The child 50 would be unable to stand on the chair 100 in this situation because the waist panel 20 restricts the rest of the baby carrier 1 from moving upwards. In other words, the child 50 would not be able to move the crotch panel 28 upwards to allow the child 50 to lift itself up on the chair 100 because the waist panel 20 anchors the baby carrier 1 securely to the seat portion of the chair 100. Of course, all fastening devices and securing devices may be tightened so that the baby carrier 1 fits closely against the chair 100 and so that the child 50 fits securely in the baby carrier 1.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of securing a child to a chair, comprising:

providing an apparatus for securing the child to a wearer in a first arrangement and for securing the child to the chair in a second arrangement comprising:

a base panel having a first edge, a second edge, and opposing third and fourth edges;

a first loop and a second loop attached to the third and fourth edges, respectively;

a crotch panel having a bottom portion, a first securing device and a second securing device and the bottom portion attached to the second edge of the base panel, wherein the first and second securing devices are configured to be threaded at least partially between the first and second loops, respectively, and wherein the securing devices of the crotch panel are configured to wrap around the back portion of the chair and fasten to each other in the second arrangement to encircle the child in combination with the bottom portion, and the bottom portion is adapted to be disposed between the child and the base panel in the first arrangement; and a waist panel attached to the second edge of the base panel such that the base panel is substantially centered upon the waist panel and comprising opposing ends, each end having a waist fastening device, wherein the waist panel is configured to wrap around the waist of the wearer in the first arrangement and to wrap around the seat portion of the chair such that the child situated within the apparatus is unable to stand upright in the second arrangement and wherein the waist fastening devices are configured to fasten to each other;

placing the apparatus on the chair with the crotch panel facing away from the back portion of the chair;

extending the first and second securing devices of the crotch panel around the back portion of the chair;

fastening the first and second securing devices of the crotch panel; and securing the waist panel around the seat portion of the chair.

2. The method of claim 1, further comprising threading the first and second securing devices of the crotch panel through the first and second loops, respectively, of the base panel.

3. The method of claim 1, further comprising tightening the fastening devices and securing devices such that the apparatus fits closely against the chair.

4. The method of claim 1, further comprising placing the child into the apparatus and tightening the fastening devices and securing devices such that the apparatus secures the child against the chair.

5. The method of claim 1, further comprising providing base fastening devices attached to the third and fourth edges and first and second arm panels attached to the third and fourth edges, respectively, and wrapping the first and second arm panels over the back portion of a chair and fastening each arm panel to one of the base fastening devices.

6. The method of claim 5, further comprising providing first and second elbow fasteners attached to the first and second arm panels, respectively.

7. The method of claim 6, further comprising fastening the first and second elbow fasteners to each other.

* * * * *